United States Patent [19]

Thibaut

[11] 3,934,433

[45] Jan. 27, 1976

[54] SWITCHING CONTROL FOR A REVERSING MOTOR OF A WASHING MACHINE

[75] Inventor: Yves Albert Daniel Thibaut, Amiens, France

[73] Assignee: U.S. Philips Corporation, New York, N.Y.

[22] Filed: Feb. 7, 1974

[21] Appl. No.: 440,340

[30] Foreign Application Priority Data

Feb. 9, 1973 France ..... 73.04659

[52] U.S. Cl. ..... 68/12 R; 8/158

[51] Int. Cl.[2] ..... D06F 33/02

[58] Field of Search ..... 68/12 R; 318/281

[56] References Cited

UNITED STATES PATENTS 3,552,156 1/1971 Toulemonde et al. ..... 68/12 R 3,689,815 9/1972 Thibaut ..... 68/12 R

*Primary Examiner*—Richard E. Aegerter
*Assistant Examiner*—Larry Jones
*Attorney, Agent, or Firm*—Frank R. Trifari; David R. Treacy

[57] ABSTRACT

A device for switching a d.c. motor of a washing machine. The drive means of the reversing device is connected in series with a pressostat. This circuit is connected in parallel with the terminals of the pump contact; a terminal of the pressostat contact and a terminal of the actuation contact of the supply module of the d.c. motor are connected. The motor of the reversing device is connected in series with the pump motor through which it is energized.

2 Claims, 2 Drawing Figures

SWITCHING CONTROL FOR A REVERSING MOTOR OF A WASHING MACHINE

The invention relates to a method of and a device for switching a d.c. motor to a high spin-drying speed. The motor drives the drum of a washing-machine in an alternating fashion at a low washing speed and continuously in a specific direction at a high spin-drying speed. A timer assembly controls the sequence and the duration of the washing operations and a reversing switch assembly which switches the electric supply unit of the drive motor of the drum at washing speed in an alternating fashion and at spin drying speed. Devices for switching on the motor of the draining pump, for switching the supply of the drive motor of the drum and for controlling the drive of the reversing switch assembly are associated with the timer assembly and can short-circuit devices which have the same functions but which are associated with the reversing switch assembly thus rendering these inoperative by means which are driven by the timer assembly. In the same way as similar devices which are associated with the reversing assembly can short circuit the said devices belonging to the timer assembly at a given instant determined by the reversal of the rotating direction at washing speed.

From French Pat. No. 2,058,524 a method is known of switching a d.c. motor to spin-drying speed by means of four contacts of a d.c. motor, which motor is powered from the a.c. mains via an electronic module, and drives the drum of a washing machine. Said method employs either a timer with one motor and electromechanical blocking of the reversing cams, or a timer with two motors: one for the programming section and one for the reversing section.

French Pat. No. 1,455,935 describes a device by means of which the reversing motor can be stopped and consequently the spin-drying contacts can be actuated at a precise instant of the reversing cycle and held in the actuated position. This is achieved by connecting the reversing switch motor in series with the spin-drying motor, which combination is connected in parallel with the washing motor. The contact which is connected to a branch of one of the phases of the supply mains, which branch is disposed between the reversing switch motor and the spin-drying motor, is locked to the energizing contact of the washing motor and functions oppositely.

The methods and devices described in the two patent specifications thus permit the spin-drying cycle to be started at a precise instant of the reversing cycle when the desired contacts of the reversing means are closed. The reversing means then stops in this position during the entire spin-drying cycle, thus ensuring a safe operation. Moreover, it is impossible to damage the machine assembly and the electronic module by an incorrect operation. As a matter of fact, the machine would become highly unstable when by operating the timer spin-drying is allowed while the preferred direction of rotation of the drum is not correct. The sudden reversal of the polarity of the motor and its power supply might lead to the immediate breakdown of the electronic components of the power supply unit. As the reversing means itself controls the acceleration to spin-drying, irrespective of the setting of the timer, this yields a greater mechanical and electrical safety.

However, there is still a risk if the reversing means is activated too soon after completion of the spin-drying cycle. One of the characteristics of a permanent-magnet motor is that it also constitutes a generator, that is it can produce a voltage which is proportional to the rotor speed. Thus, during the entire deceleration period after completion of spin-drying a voltage appears at the terminals of the brushes which decreases gradually. For example, in said French Pat. No. 2,058,524 the voltage at the motor terminals is of the order of 200 Volts. Immediately after the electronic module is switched off, the motor keeps rotating as a result of its inertia and that of the loaded drum. This period of deceleration may last several tens of seconds. Throughout said period the voltage at the terminals decreases gradually from 200 V to 0 V. If it is assumed that the reversing means when started again rapidly changes over the two opposite contacts, the supply voltages and the motor voltages are suddenly reversed. This results in a short circuit which is the more violent because the voltage is high.

The invention is based on the previously described devices and its object is to avoid short-circuits that would occur if the reversing switch means were started again while the drum had not yet stopped. Moreover, it has the advantage of greater simplicity because it employs existing elements of the washing-machine.

According to the invention, the switching method is characterized in that the control of the reversing switch assembly is applied in series with the pump motor drive.

According to the invention, a device for switching a d.c. motor of a washing machine to spin-drying speed, comprises a timer assembly and a reversing switch assembly whose drive means are independent, make or break contacts for the pump motor, for the electronic supply module, for the drive motor of the drum and for the drive of the reversing switch assembly, the circuits constituted by a contact of the pump motor which is controlled by the timer in series with said pump motor and by an energizing contact of the electronic d,c. supply module of the drive motor of the drum in series with said power supply being supplied in parallel from the a.c. mains, wherein a circuit formed by a delayed contact in series with the drive means of the reversing switch assembly is connected in parallel with the terminals of the contacts of the pump motor, the terminal of the delayed contact which also forms a terminal of the drive means of the reversing switch assembly and the terminal of the energizing contact of the electronic module, which terminals are not permanently connected to a phase of the a.c. mains, being interconnected.

The delayed contact is constituted by the device which senses the water level in the tub of the machine.

In order that the invention be understood more fully reference is made to the following descriptions and Figures which are given by way of example.

FIG. 1 represents the device which controls the rotating direction of a permanent-magnet d.c. motor described in Franch Pat. No. 2,058,524, the reversing device being stopped during acceleration to spin-drying speed by selection of the contacts of the reversing switch means for a preferred direction of rotation.

Figure 1:
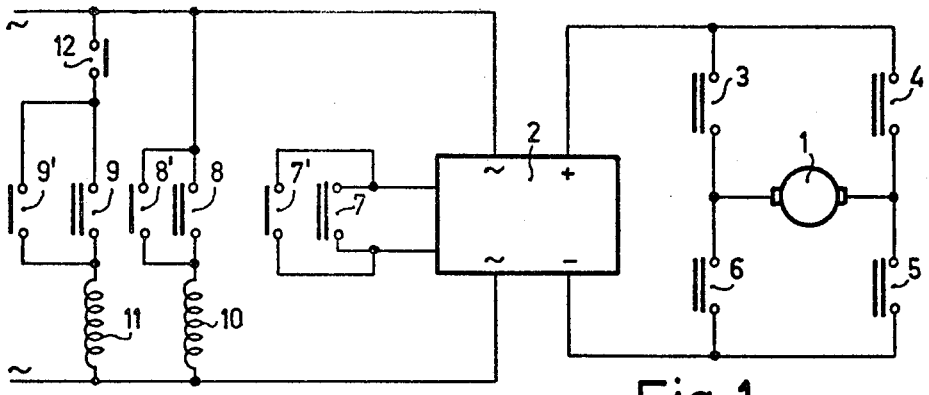
FIG. 1 is a schematic diagram of a device for stopping the reversing means in a specific position in accordance with the prior art.

The drive motor 1 of the drum is d.c. motor powered by an electronic module 2 which consists of a semi-conductor rectifier bridge and a reversing switch assembly of contacts 3, 4, 5, 6.

To reverse the running direction, the polarity at the motor terminals is reversed by closing the contacts 3 and 5 or 4 and 6 respectively in the desired rhythm. To increase the speed of the drum from the washing speed (approx. 50 rpm) to the spin-drying speed (500 to 1000 rpm) the supply current at the terminals of the drive motor is varied and the reversing switch means is put out of action, which necessitates the use of independent drives for the timer and for the reversing switch means. Acceleration to spin-drying speed in a preferred direction is achieved by the following combination of contacts (the contacts represented by two dashes are associated with the reversing means and those represented by a single dash with the timer): the reversing contact 7 controls the power supply 2 of the motor 1, when 7 is closed the current which is supplied to the motor corresponding to the low washing speed; when it is open said current corresponds to the spin-drying speed. The contact is open at a specific position of the reversing cycle (for example when 3 and 5 are closed). In order to ensure a specific rotating direction during spin-drying, the motor 10 of the reversing switch means is stopped by opening contact 8. Reversing contact 9 which energizes the pump for draining the tub 11, is closed when the motor 10 of the reversing means has stopped. Contacts 7′ 8′, 9′ are timer contacts which ensure normal operation if no spin-drying is required. Contact 12 is the timer contact which controls the draining cycle.

The operation of the device is as follows: during washing, contacts 7, 8, 9 are short-circuited by contacts 7′, 8′, 9′ which are controlled by the timer; while the reversing means rotates, the d.c. motor rotates in accordance with a specific rhythm and in the two directions of rotation.

During spin-drying, acceleration is effected in two steps. First of all, the timer contacts 7′, 8′, 9′ open. Contact 8 of the motor of the reversing means remains closed, the d.c. motor is still supplied with the "washing" voltage, the motor of the reversing means keep rotating.

Subsequently, at a given instant of the reversing cycle (when 3 and 5 are closed) the motor of the reversing means stops because 8 is open and spin-drying commences because 7 is open.

From the above description of the operation it appears that if at the end of the spin-drying cycle the machine is immediately re-started, the motor of the reversing means will be re-energized and rapidly switches the two contacts opposite 3 and 5, that is 4 and 6, and the supply voltages and the motor voltage are suddenly reversed. This causes a short-circuit which becomes the more severe as the voltage supplied by the motor is higher.

The invention provides a method and a device which assure absolute safety when spin-drying is discontinued and which permit the previously described circuits to be simplified.

Figure 2:
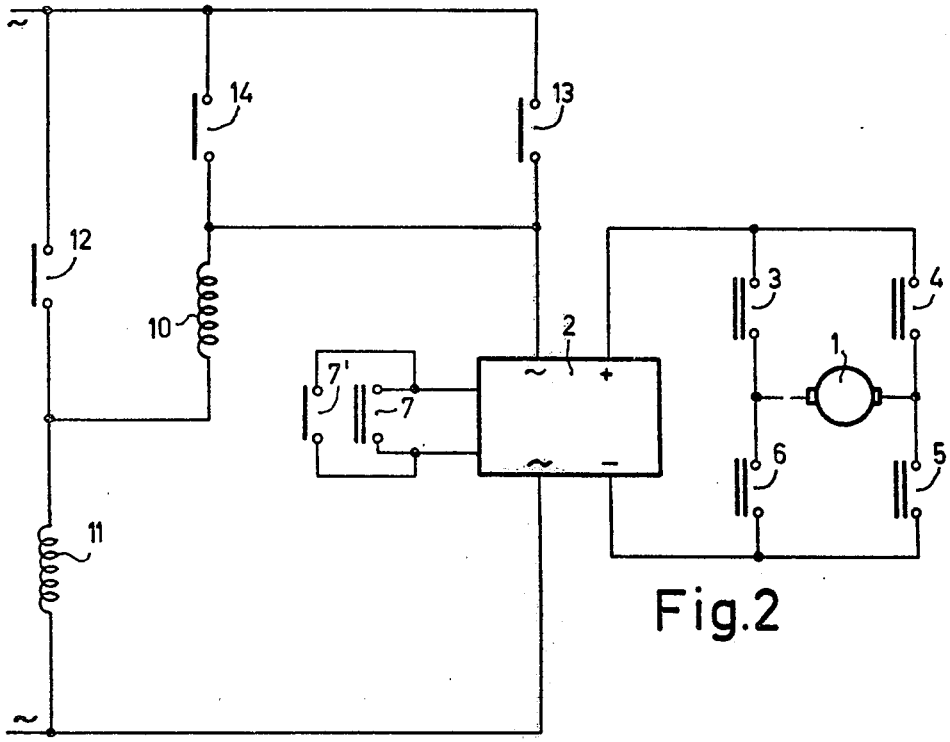
FIG. 2 is a schematic diagram of a device according to the invention.

In FIG. 2 elements which are equivalent to those of the previous embodiment have the same reference numerals and functions.

The operation of the various elements is as follows:

During the washing-cycle, contacts 12 and 13 of the timer are open and a delay means 14 closes the circuit a certain time after the machine is started. The motor 1 is energized by the electronic module 2, whose one of terminals is connected directly to one phase of the mains, and the other terminal to the second phase of the mains through contact 14; contacts 7 and 7′ are open, thus allowing the motor to be energized with a voltage corresponding to the washing speed. The motor of the reversing means 10 is energized through contact 14 which is closed and the pump motor 11. As the impedance of the motor of the reversing means is high relative to the impedance of the pump motor, the pump motor cannot start. The motor 1 alternately rotates in either direction at the washing speed.

When the timer advances to the spin-drying cycle, contact 12 which is controlled by the timer closes, pump motor 11 is started, contact 7 closes when contacts 3 and 5 which define the preferred direction of rotation are closed and, spin cycle contact 13 also closes and short-circuits contact 14 which opens after a relatively short time. At the same instant the motor of the reversing means 10 is stopped and maintains the position of contacts 3 and 5 for the duration of the spin-drying cycle.

When the spin-drying cycle is discontinued because the electronic module 2 is switched off, contacts 12 and 13 of the timer open, motor 10 of the reversing means remain stopped and pump motor 11 are stopped. The motor 10 of the reversing means then cannot be started until after the delay contact 14 has closed the circuit. This allows motor 1 to come to a complete standstill before commencing with a new cycle of the revolutions.

In an embodiment of the washing-machine in which switching to spin-drying should take place with filled tub, the delay means is constituted by the pressostat contact.

Apart from the advantages of assuring change-over to spin-drying in a specific direction of rotation, independently of any change in timer setting, the pump motor 11 is switched on by a contact at a previously determined instant and without any other means short-circuits the motor 10 of the reversing means. Consequently, it is not necessary to use one or two additional contacts as described in French Pat. No. 2,058,524. The pump contact 12 alone performs the functions of controlling the pump and blocking the reversing means.

A device embodying the method according to the invention employs the arrangement of the elements as shown in FIG. 2 and in said device the function of the delayed contact 14 is performed by the pressostat (in the case of a machine which changes over to spin-drying with filled tub), contact 12 of the timer being an existing contact because this serves for starting the pump motor.

Thus, connected in parallel with the mains terminals are the circuit formed by contact 12 of the pump motor in series with the pump motor 11 and the circuit formed by the spin cycle energizing contact 13 of the electronic module 2 and the electronic module. Parallel connected with contact 12 is the circuit with the delayed contact 14 (pressostat) in series with the motor 10 of the reversing means (or any other means which permits or prevents the reversing section of the timer from being driven. The delayed contact 14 and the motor of the reversing means 10 are consequently connected in series with the motor [illegible] the draining pump. The terminals of contacts 13 and 14, which are not permanently connected to the phase of the mains, are connected.

This arrangement, compared with the arrangement described with reference to FIG. 1 allows four contacts (two reversing contacts and two timer contacts) to be dispensed with, which apart from providing operational safety results in a simplification of the timer-reversing device and consequently a substantially reduced cost price.

What is claimed is:

1. A device for switching a drum drive motor of a washing machine, comprising a pump motor having a first line connection and a switch connection; a drum drive motor; an electronic supply module having a first line connection and a switch connection, and output connections; timer contacts, including a pump motor contact having a second line and a motor connection, and a spin cycle contact having a second line and a module connection; a reversing switch assembly; means for connecting said drum drive motor to said electronic supply module output connections via said reversing switch assembly; means for driving the reversing switch assembly having first and second input connections; a delay contact having second line and motor connections; and means for connecting said first line connections together and said second line connections together and for connecting first and second line connections to a source of electric power; wherein said pump motor contact motor connection, pump motor switch connection and first input connection are connected together, and said delay contact motor connection, spin cycle contact module connection, electronic module switch connection and second input connection are connected together, whereby said delay contact and drive means for the reversing switch form a series circuit in parallel with the pump motor contact, and said delay contact and spin cycle contact are in parallel for supplying power to said electronic control module.

2. A device as claimed in claim 1 wherein said delay contact is a contact of a device which senses water level.

* * * * *